US007973724B2

(12) United States Patent
Shan et al.

(10) Patent No.: US 7,973,724 B2
(45) Date of Patent: Jul. 5, 2011

(54) WIRELESS CHIP AND WIRELESS DEVICE

(75) Inventors: Wenying Shan, Beijing (CN); Jianjun Zhi, Beijing (CN); Yi Gao, Beijing (CN); Ying Li, Beijing (CN)

(73) Assignees: Legend Holdings, Ltd., Beijing (CN); Lenovo (Beijing) Limited, Beijing (CN)

( * ) Notice: Subject to any disclaimer, the term of this patent is extended or adjusted under 35 U.S.C. 154(b) by 662 days.

(21) Appl. No.: 12/080,306

(22) Filed: Apr. 2, 2008

(65) Prior Publication Data

US 2010/0321252 A1 Dec. 23, 2010

(30) Foreign Application Priority Data

Apr. 3, 2007 (CN) ..... 2007 1 0065103

(51) Int. Cl.
*H01Q 1/24* (2006.01)
*H01Q 1/52* (2006.01)

(52) U.S. Cl. ..... 343/702; 343/700 MS; 343/841

(58) Field of Classification Search ..... 343/702, 343/700 MS, 787, 841
See application file for complete search history.

(56) References Cited

U.S. PATENT DOCUMENTS

| | | | | |
|---|---|---|---|---|
| 5,801,660 | A * | 9/1998 | Ohtsuka et al. | 343/700 MS |
| 6,556,169 | B1 * | 4/2003 | Fukuura et al. | 343/700 MS |
| 6,585,951 | B1 * | 7/2003 | Hong et al. | 423/598 |
| 6,869,683 | B2 * | 3/2005 | Sakurai et al. | 428/448 |
| 2003/0193446 | A1 * | 10/2003 | Chen | 343/893 |

* cited by examiner

*Primary Examiner* — Hoang V Nguyen
(74) *Attorney, Agent, or Firm* — Kinney & Lange, P.A.

(57) ABSTRACT

The present invention discloses a wireless chip comprising a circuit layer above which a microstrip antenna is provided, and a wave-absorbing body is provided between the circuit layer and the microstrip antenna. Since the microstrip antenna is disposed above the circuit layer, the wave-absorbing body capable of absorbing energy is utilized to isolate the circuit from the antenna, and the metal film in the microstrip antenna functions not only as the RF ground of the antenna but also as a shield against any interference, it is possible to effectively address the problem of the antenna interfering with the circuit; by selecting the medium with suitable dielectric constant, the height of the chip can be prevented from being unduly increased, thereby ensuring that the chip and the wireless device using the same are both small in size. The present invention also discloses the wireless device containing the wireless chip.

9 Claims, 2 Drawing Sheets

WIRELESS CHIP AND WIRELESS DEVICE

BACKGROUND OF THE INVENTION

1. Field of Invention

The present invention relates to the field of antenna technology, and in particular to a chip incorporating antenna function and a wireless device using such chip incorporating antenna function.

2. Description of Prior Art

Antenna is an indispensable part of a wireless device and usually present as a separate element. Due to its various advantages, such as convenient in feed point, small in weight, cheap in price, excellent in mobility and less radiation to human body, a built-in antenna has recently gained rapid development and wide application, and a growing number of mobile wireless devices, such as client wireless network card of WLAN (Wireless Local Area Network), cell phone, PDA (Personal Digital Assistant) device and receiver of GPS (Global Positioning System), are operating with such built-in antenna.

An introduction will now be given to two typical implementations of the conventional built-in antenna.

(1) A Unipole Antenna Encircling A Chip

Referring to FIG. 1 which is a schematic diagram of the first implementation of a built-in antenna.

Such antenna acts as a loop antenna since it encircles the chip. According to certain principle in physics, if there is any alternating current flowing through a loop conducting line, magnetic flux is generated within the loop, and the alternating magnetic field gives rise to an electric field, which may disturb circuits on the chip. In addition, a loop antenna is generally low in efficiency, and therefore N (N is an integer greater than 1) turns of such antenna are often used for efficiency enhancement, which may accordingly increase the radiation resistance by a multiple of $N^2$ and thus the disturbance to the adjacent chip circuits.

(2) An Antenna Positioned In Proximity of A Chip

Referring to FIG. 2 which is a schematic diagram of the second implementation of the built-in antenna.

Such implementation expands the overall area of the chip to such a considerable extent that it cannot meet the requirement of smallness in designing a modern wireless device. Also, since the antenna is positioned in the same plane as the chip, the disturbance to the chip cannot be avoided whether the antenna is omnidirectional or unidirectional.

SUMMARY OF THE INVENTION

In view of the above problems, the present invention provides a wireless chip including an antenna and a circuit that is free from interference by the antenna. The present invention also provides a wireless device using such chip.

To achieve the above object, embodiments of the present invention adopt the following solutions.

A wireless chip comprises a circuit layer above which a microstrip antenna is provided, and a wave-absorbing body is provided between the circuit layer and the microstrip antenna.

A wireless device comprises a wireless chip comprising a circuit layer above which a microstrip antenna is provided, and a wave-absorbing body is provided between the circuit layer and the microstrip antenna.

Said microstrip antenna is formed of a metal film, a medium and a radiation body, said metal film is provided above said wave-absorbing body, said medium is provided above said metal film, and said radiation body is provided above said medium.

Said circuit layer has a feed point and a ground, said radiation body has a feed point and a ground, and the feed point and ground of said radiation body is connected to the feed point and ground of said circuit layer, respectively. Said metal film is grounded.

Said wave-absorbing body is a wave-absorbing material of ferrite particle absorber or of nano-meter barium ferrite absorber.

Said medium has a dielectric constant between 4 and 6 or between 10 and 20.

Said medium is epoxy, bakelite, PTFE (polytetrafluoroethylena), LAO (lanthanum aluminate) or LAON (lanthanum aluminum oxynitride).

Said wireless device is a mobile phone, a PDA device or a receiver of GPS.

The solutions described above have the following effects:

(1) the microstrip antenna is disposed above the circuit layer, the wave-absorbing body capable of absorbing energy is utilized to isolate the circuit from the antenna, and the metal film in the microstrip antenna functions as a shield against any interference, it is therefore possible to effectively address the problem of the antenna interfering with the circuit;

(2) by selecting the medium with suitable dielectric constant, the height of the chip can be prevented from being unduly increased, thereby ensuring that the chip and the wireless device using the same are both small in size.

DETAILED DESCRIPTION OF PREFERRED EMBODIMENTS

The present invention utilizes a microstrip antenna to achieve the integration of an antenna with a circuit chip. In this way, the height of the circuit chip is merely increased slightly, and on the other hand, the interference from the antenna to the chip circuit can be effectively, reduced at the same time of reduction in chip area.

As mobile wireless devices prevail, the microstrip antenna has been widely applied due to its characteristics, such as easy to fabricate, exquisite appearance and lower radiation to human body. Besides, the performance of the microstrip antenna is improved through various technical measures, such as improving the bandwidth and radiation efficiency of the antenna by refining the area and shape of a Patch. As a result, the application of the microstrip antenna grows considerably. Regarding the principle and application of the microstrip antenna, reference can be made to a book titled "Microstrip Antenna" translated by Liang Iianzhuo from Tsinghua University and published by Posts & Telecom Press.

Unlike the existing implementation of a built-in antenna utilizing a unipole antenna, the present embodiment provides a microstrip antenna above an original circuit layer and also a wave-absorbing body between the circuit layer and the microstrip antenna.

The main function of the wave-absorbing body is absorbing energy on respective frequency bands so as to prevent the energy being reflected onto the circuit layer. The wave-absorbing body can be embodied with many different types of wave-absorbing materials, for example, ferrite particle asborber or nano-meter barium ferrite absorber.

Figure 1:
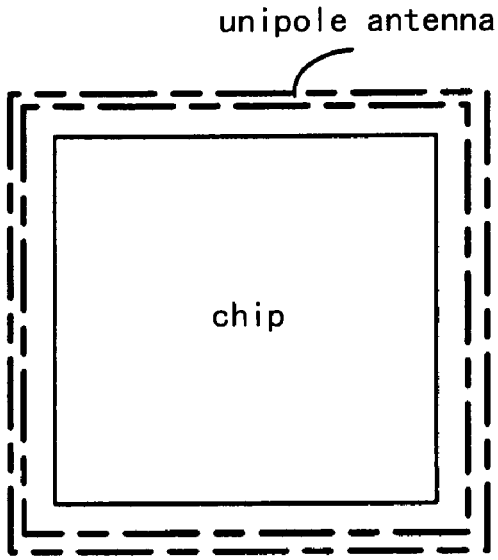
FIG. 1 is a schematic diagram of the first implementation of a conventional built-in antenna.
Figure 2:
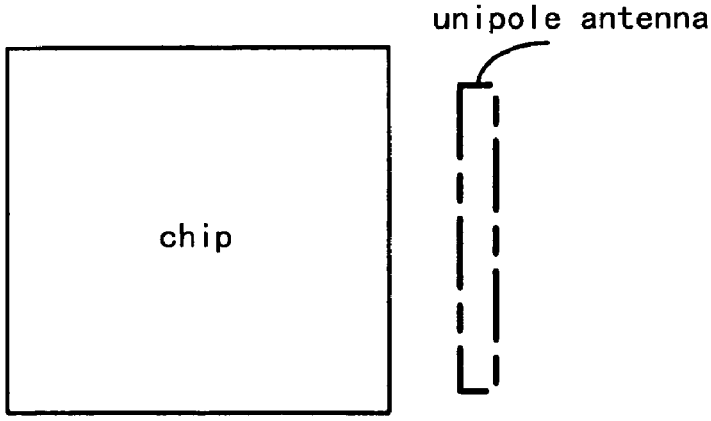
FIG. 2 is a schematic diagram of the second implementation of a conventional built-in antenna.
Figure 3:
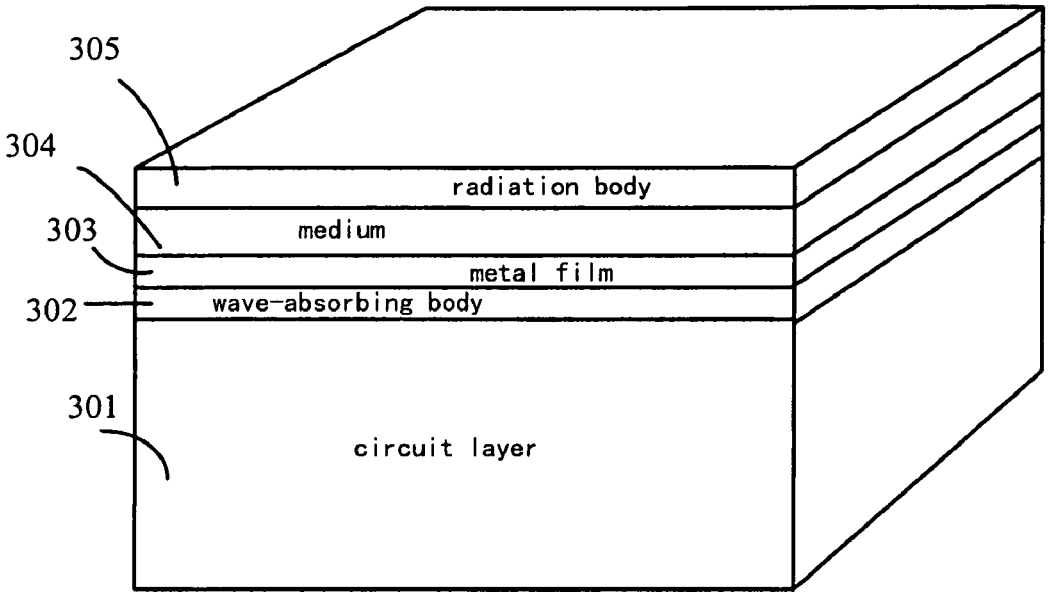
FIG. 3 is a schematic block diagram of a wireless chip as an embodiment of the present invention.

Referring to FIG. 3 which is a schematic block diagram of a wireless chip as an embodiment of the present invention.

As shown in this figure, a wave-absorbing body 302, a metal film 303, a medium 304 and a radiation body 305 are added to the chip which originally has only a circuit layer 301, and the metal film 303, the medium 304 and the radiation body 305 constitute a microstrip antenna.

The circuit layer 301 can comprise a number of functional circuit modules, for example, RF (Radio Frequency) modem, power amplification module and transmitting/receiving switch. During a specific operation, all the functional circuit modules are integrated into a single silicon wafer, and antenna feed point and ground is left outside the silicon wafer for use in incorporating an antenna.

The actual design begins with overlaying, the wave-absorbing body 302 on the circuit layer 301 and overlaying the metal film 303 on the wave-absorbing body 302, with the metal film 303 being grounded. Then, the metal film 303 is overlaid with the medium 304, which is then covered with the radiation body 305. A feed point is also provided on the radiation body 305 and connected to the feed point externally to the silicon wafer. Meanwhile, the radiation body 305 is connected to the ground with it's ground point. Finally, the circuit layer 301, the wave-absorbing body 302, the metal film 303, the medium 304 and the radiation body 305 are all packaged together to form a wireless transceiving chip with antenna function.

During the specific design, a through hole can be provided in the wireless transceiving chip, and the feed point or ground of the radiation body 305 can be connected to the feed point or ground of the circuit layer 301 via the through hole. The metal film 303 can be grounded through the boundary of the circuit layer 301.

Next, a further description will be given to respective components of the microstrip antenna.

1) The metal film 303 acts primarily as antenna radiation ground, and it also serves as a shield against interference.

As to how the metal film 303 acts as a shield against interference, related principle and analysis are given as follows.

An electromagnetic field can penetrate into a physical conductor while it amplitude is attenuated in a exponential form of $\exp(-z/\delta_s)$, where z represents the depth for which the electromagnetic field enters the conductor, and $\delta_s$ is referred to as skin depth.

The thickness of the metal film 303 is calculated from the Skin Effect and given by the equation $$\delta_s=[2/(\omega\mu_0\sigma)]^{0.5}$$

For the metal film 303 made of iron substance, $\sigma=10^7$ S/m, $\mu_0=4\pi\times10^{-7}$ H/m. For 2.4 GHz, $$\delta_s=[2/(\omega\mu_0\sigma)]^{0.5}=3.25\times10^{-3}\text{ mm}$$

Such thickness of $3.25\times10^{-3}$ mm is far less than the general metal shielding thickness of 0.2 mm, and thus the use of a general shielding-cap-typed metal film can sufficiently satisfy the requirement.

Based on the above analysis, any generic metal can meet the requirement on the metal film 303 in the present invention, and copper or steel is preferably used.

Therefore, with the energy absorption by the wave-absorbing body 302 and the interference shielding by the metal film 303, the circuit layer can be effectively prevented from any interference by the antenna.

2) The medium 304 is usually selected as a medium having a dielectric constant in the range from 4 to 6 or from 10 to 20.

The dielectric constant is used to measure the performance of an insulator in terms of electric power storage, and it is the ratio of two capacitance values obtained respectively when an insulating material is used as the medium between two metal boards and when air or vacuum is used as such medium. The dielectric constant represents the polarization degree, that is, the ability to constrain charges, of a dielectric, and the larger the dielectric constant is, the stronger the ability to constrain charges is.

Therefore, a larger dimension in height is required if the dielectric constant is too small, while the energy dissipation will be increased and the radiation efficiency be decreased if the dielectric constant too large. In this embodiment, the preferred medium material for the medium 304 can have a dielectric constant between 4 and 6, such as Fr4-epoxy, bakelite (also referred to as artificial gum) and PTFE, or have a dielectric constant between 10 and 20, such as LAO and LAON.

3) The radiation body 305 can utilize a generic type of metal material and preferably copper or steel.

The wireless chip of the present embodiment not only has the function of wireless transceiving but also effectively prevents the circuit from being interfered by the antenna while guaranteeing a small and practical chip.

The reason for the above advantages is as follows.

(1) by adding the wave-absorbing body 302 capable of absorbing energy and the metal film 303 serving as a shield against interference on the circuit layer 301, the circuit is isolated from the antenna, and it is therefore possible to effectively solve the problem of interfering the circuit by the antenna;

(2) by selecting the medium 304 with suitable dielectric constant, the height of the chip can be prevented from being unduly increased, thereby ensuring that the chip and the wireless device using the same are both small in size.

Figure 4:
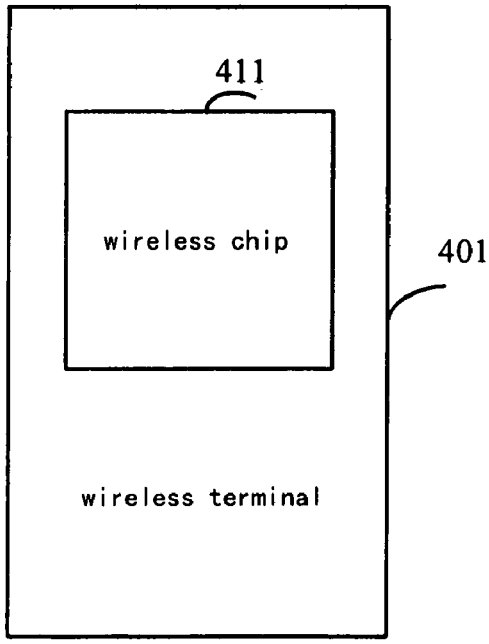
FIG. 4 is a schematic diagram of a wireless device as an embodiment of the present invention.

Referring to FIG. 4 which is a schematic diagram of a wireless device 401 containing a wireless chip 411.

The wireless chip 411 is a chip having the function of wireless transceiving or a radio single chip and has an internal structure shown in FIG. 3. The specific implementation of this chip 411 is the same as described above, and thus the description thereof is omitted.

The wireless device 401 can be a client wireless network card of WLAN, a mobile phone, a PDA device, a receiver of GPS and the like.

By utilizing the wireless chip 411, a built-in antenna can be achieved within the wireless device 401, and the antenna has no interference with the circuit. Meanwhile, thanks to the small size of the wireless chip 411, the size of the wireless device 401 does not need to be expanded and thus can meet the requirement of a small and exquisite appearance with respect to the modern wireless devices.

The foregoing description is intended to illustrate the preferred embodiments of the present invention. It should be noted that, for those ordinarily skilled in the art, various improvements and refinements can be made within the principle of the present invention and thus should be construed as belonging to the scope of the present invention.

What is claimed is:

1. A wireless chip comprising a circuit layer and characterized in that a microstrip antenna is provided above said circuit layer, and a wave-absorbing body is provided between said circuit layer and said microstrip antenna, wherein said microstrip antenna is formed of a metal film, a medium and a radiation body, said metal film is provided above said wave-absorbing body, said medium is provided above said metal film, and said radiation body is provided above said medium, and said circuit layer comprises a modem circuit module.

2. The wireless chip of claim 1, characterized in that said circuit layer has a feed point and a ground, said radiation body has a feed point and a ground, and the feed point and ground of said radiation body is connected to the feed point and ground of said circuit layer, respectively; and said metal film is grounded.

3. The wireless chip of claim 1, characterized in that said wave-absorbing body is a wave-absorbing material of ferrite particle absorber or of nano-meter barium ferrite absorber.

4. The wireless chip of claim 1, characterized in that said medium has a dielectric constant between 4 and 6 or between 10 and 20.

5. The wireless chip of claim 4, characterized in that said medium is epoxy, bakelite, PTFE (polytetrafluoroethylena), LAO (lanthanum aluminate) or LAON (lanthanum aluminum oxynitride).

6. A wireless device comprising a wireless chip which comprises a circuit layer, said wireless device being characterized in that a microstrip antenna is provided above said circuit layer, and a wave-absorbing body is provided between said circuit layer and said microstrip antenna, wherein said microstrip antenna is formed of a metal film, a medium and a radiation body, said metal film is provided above said wave-absorbing body, said medium is provided above said metal film, and said radiation body is provided above said medium, and said circuit layer comprises a modem circuit module.

7. The wireless device of claim 6, characterized in that said circuit layer has a feed point and a ground, said radiation body has a feed point and a ground, and the feed point and ground of said radiation body is connected to the feed point and ground of said circuit layer, respectively; and said metal film is grounded.

8. The wireless device of claim 6, characterized in that said medium has a dielectric constant between 4 and 6 or between 10 and 20.

9. The wireless device of claim 6, characterized in that said wireless device is a mobile phone, a Personal Digital Assistant device or a receiver of Global Positioning System.

* * * * *

UNITED STATES PATENT AND TRADEMARK OFFICE

CERTIFICATE OF CORRECTION

PATENT NO. : 7,973,724 B2
APPLICATION NO. : 12/080306
DATED : July 5, 2011
INVENTOR(S) : Wenying Shan et al.

It is certified that error appears in the above-identified patent and that said Letters Patent is hereby corrected as shown below:

Col. 2, Line 48
Delete "," after "effectively"

Col. 3, Line 21
Delete "," after "overlaying"

Col. 4, Line 19
Insert --is-- after "constant"

Signed and Sealed this
Nineteenth Day of February, 2013

Teresa Stanek Rea
*Acting Director of the United States Patent and Trademark Office*